US007333062B2

(12) United States Patent
Leizerovich et al.

(10) Patent No.: US 7,333,062 B2
(45) Date of Patent: Feb. 19, 2008

(54) WIRELESS COMMUNICATION DEVICE WITH INTEGRATED ANTENNA

(75) Inventors: Gustavo D. Leizerovich, Aventura, FL (US); Donald W. Burnette, Sunrise, FL (US); Julio C. Castaneda, Coral Springs, FL (US); Orlando Gomez, Hialeah, FL (US)

(73) Assignee: Motorola, Inc., Schaumburg, IL (US)

( * ) Notice: Subject to any disclaimer, the term of this patent is extended or adjusted under 35 U.S.C. 154(b) by 98 days.

(21) Appl. No.: 11/227,367

(22) Filed: Sep. 15, 2005

(65) Prior Publication Data

US 2007/0057852 A1 Mar. 15, 2007

(51) Int. Cl.
*H01Q 1/24* (2006.01)

(52) U.S. Cl. ..... 343/702; 343/873

(58) Field of Classification Search ..... 343/702, 343/741, 866, 872, 742, 867, 873
See application file for complete search history.

(56) References Cited

U.S. PATENT DOCUMENTS

| | | | | |
|---|---|---|---|---|
| 5,710,987 | A * | 1/1998 | Paulick | 455/575.7 |
| 2005/0064814 | A1 | 3/2005 | Matsuo et al. | |
| 2005/0075079 | A1 | 4/2005 | Jei et al. | |

* cited by examiner

*Primary Examiner*—Hoanganh Le

(57) ABSTRACT

A near field communication loop antenna (308) is mechanically coupled to the cover (300) of a cellular telephone. The antenna (308) is coupled on the inside of the cover (300) between a keypad (302) and the cover (300), whereby the antenna (308) surrounds the keys (314) and is sandwiched between the keypad assembly (302) and the cover (300). A near field communication antenna (406) is coupled to the outside surface of the cover (300) surrounding a display and sandwiched between a lens (400) and the phone cover (300). A near field communication antenna embedded in the phone cover material, whereby the antenna surrounds either the keys or the display, is disclosed as well.

7 Claims, 4 Drawing Sheets

WIRELESS COMMUNICATION DEVICE WITH INTEGRATED ANTENNA

CROSS-REFERENCE TO RELATED APPLICATION

The present patent application is related to co-pending and commonly owned U.S. patent application Ser. No. 11/227,011, entitled "WIRELESS COMMUNICATION DEVICE WITH INTEGRATED BATTERY/ANTENNA SYSTEM," filed on even date with the present patent application, the entire teachings of which being hereby incorporated by reference.

FIELD OF THE INVENTION

The present invention generally relates to the field of radio frequency antennas and more particularly to near-field antennas integrated into a wireless communication device.

BACKGROUND OF THE INVENTION

The progression of features and performance of portable wireless communications devices, such as cellular telephones, PDAs and the like, has occurred at an almost exponential rate since the devices were first introduced into the consumer market. Manufacturers are constantly working to reduce the size, extend battery life, and increase communication reliability and range. In addition, the devices now commonly have features such as picture, video, and sound recorders, organizers, synthesized ring tones, email and text messaging service, video games, and others.

Ironically, as phone manufacturers have worked to achieve longer and longer transmission distance capabilities, one new feature that can currently be found in some devices, but is being developed for more widespread use, is close-range data transferring capability, referred to as "Near Field Communication" or "NFC". That is to say, it is desirable that the device is not able to send certain types of signals very far. One use of this feature can be, for instance, to communicate one's credit card information to complete a retail purchase. Ideal transmission in this mode is a very short distance, usually no more than four feet (~10 cm or 4 inches).

For this short-range transmission, an additional NFC antenna is needed. Several phone manufacturers have added NFC capabilities to their products. However, the additional feature has lead to an increase in overall product size. Consumers continue to demand that wireless devices decrease in size.

Therefore a need exists to overcome the problems with the prior art as discussed above.

SUMMARY OF THE INVENTION

Briefly, in accordance with the present invention, disclosed is an apparatus for wireless communication. The apparatus includes a cover for a mobile communication device. The cover has an inside surface and an outside surface. A near field communication antenna is mechanically coupled to the inside surface of the cover and a keypad is mechanically coupled to the cover so that the near field communication antenna at least partially surrounds a set of keys on the keypad.

In one embodiment of the present invention, the near field communication antenna is a loop antenna and is at least partially sandwiched between a portion of the keypad and the cover.

In another embodiment of the present invention, the near field communication antenna is mechanically coupled to the outside surface of the cover and a lens is mechanically coupled to the cover so that the antenna is located between the cover and at least a portion of the lens.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

DETAILED DESCRIPTION

As required, detailed embodiments of the present invention are disclosed herein; however, it is to be understood that the disclosed embodiments are merely exemplary of the invention, which can be embodied in various forms as illustrated in the non-limiting exemplary embodiments of FIGS. 1-5. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically.

Wireless communication is well known to those having ordinary skill in the art and is accomplished through use of a radio connected to an electromagnetic radiating and receiving element, or antenna. An antenna is an impedance-matching device used to absorb or radiate electromagnetic waves into or from free space. The function of the antenna is to "match" the impedance of the propagating medium, which is usually air, to the radio frequency (RF) signal source. Radio signals include voice communication channels, data link channels, and navigation signals.

One specific commonly-used type of antenna is a "loop" antenna. A loop antenna is "closed-circuit" antenna. That is, one in which a conductor is formed into one or more turns so that its two ends are close together. A current is then passed through the conductor, which has inductive properties, causing an electromagnetic wave to be radiated. These types of antennas are well known to those of ordinary skill in the art. Although the name seems to imply that the antenna shape is round, loop antennas may take many different forms, such as rectangular, square, triangle, ellipse, and many others.

Figure 1:
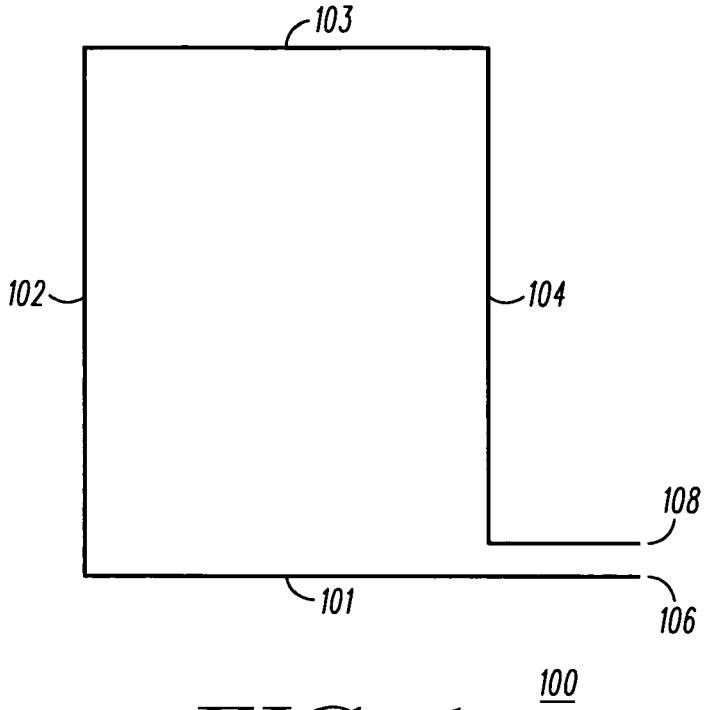
FIG. 1 is an aerial view of a loop antenna suitable for use in an embodiment of the present invention.

One embodiment of a loop antenna 100, in accordance with the present invention, is shown in FIG. 1. The antenna 100, as shown, is rectangular in shape and includes four sides 101, 102, 103, & 104 conductively connected and forming a loop. In the illustrated embodiment, the opposing sides 101 and 103 and 102 and 104 are of equal length and substantially parallel to each other. However, the antenna is not restricted to any particular shape. In some embodiments, the loop includes multiple turns. In the exemplary embodiment, the loops are all coplanar, but this is not a necessity.

The loop antenna 100 also includes two feed points 106 and 108. Feed point 106 is an extension of side 101 and feed point 108 is an extension of side 104. Feed points 106 and 108 are isolated from each other and are used to energize the loop with RF signals.

A small loop (circular or square) is equivalent to a small magnetic dipole whose axis is perpendicular to the plane of the loop. In other words, the electromagnetic fields radiated or received by an electrically small circular or square loop is similar to those fields radiated by a small dipole antenna. Dipoles are well known in the art.

Figure 2:
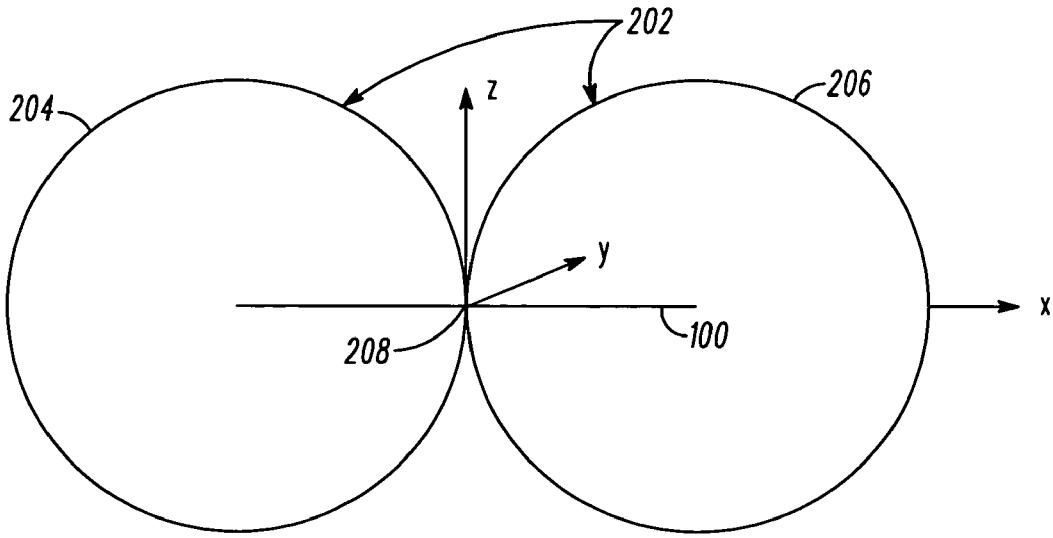
FIG. 2 is an illustration of a radiation pattern of the loop antenna of FIG. 1.

FIG. 2 illustrates an exemplary radiation pattern produced by the exemplary loop antenna of FIG. 1. In the illustration, the loop antenna 100 is shown from a side view, where the conductive length of the antenna element lies along a single plane, shown as a straight, horizontally-oriented line. Emitted from the loop antenna 100 is a radiation pattern 202, that, from the side view shown, resembles two adjacent circles 204 and 206 with an edge of each circle intersecting the antenna 100 at a center point 208. The circles represent radiating electromagnetic waves traveling through space. In a three dimensional view, the radiation pattern 202 resembles a doughnut shape, where the circles 204 and 206 come out of the page and connect to each other to form one continuous set of radiated waves.

Axes x, y, and z are shown in FIG. 2. The radiation pattern is substantially uniform along the x-y plane. A "null" occurs along the z axis, where little or no signal is radiated. As is shown by the illustrated circular patterns 202 and 204, as one moves from directly on the z axis toward a plane defined by the x and y axes, the radiation field of the antenna is entered into and radiation strength increases until maximum reception is reached along the x, y plane.

A loop is considered "small" when the current distribution in the loop is the same as in a coil. That is, the current is in the same phase and has the same amplitude in every part of the loop. To meet this condition, the total length of the conductor in the loop should not exceed about 0.08 of a wavelength.

Loop antennas with electrically small circumferences or perimeters have small radiation resistances that are usually smaller than their loss resistances. As a result, loop antennas with electrically small circumferences or perimeters are very poor radiators and are able to communicate only short distances. For this reason, a small loop antenna is well suited for what is referred to as "near field communication", or NFC.

Near field communication, or NFC, refers to communication that is transmitted and received in close proximity to a second transceiver, i.e., short range communication, regardless of protocol or standards used. Near field communication includes use of any suitable antenna for short range communication, such as, and without limitation, for effecting financial card transactions and the like, as should be obvious to those of ordinary skill in the art in view of the discussion in this specification.

As an example, near field communication, or NFC, is often transferred at a frequency of about 13.5 MHz, but other frequencies can be used. It is contemplated that the near field communication, or NFC, mode of the present invention complies with all types of short range communication standards, such as either ECMA-340 or ECMA-352 Near Field Communication Interface and Protocol standards; however, the invention is not so limited. The near field communication, or NFC, can also encompass other standards, such as ISO 14443 (proximity) and ISO 15963 (vicinity) for example, and also other frequencies or ranges of frequencies as should be obvious to those of ordinary skill in the art in view of the present discussion.

This type of communication is typically used for low power, low data rate applications, such as electronic identification or other information exchange transactions. In an embodiment of the present invention, for example and not for any limitation of the scope of alternatives, the maximum communication range is typically less than one foot (~4 inches). For example, credit card information can be exchanged between a wireless device and a vendor. In this type of transaction, it is desirable not to send this private information to a range that can be received by those in the vicinity.

Figure 3:
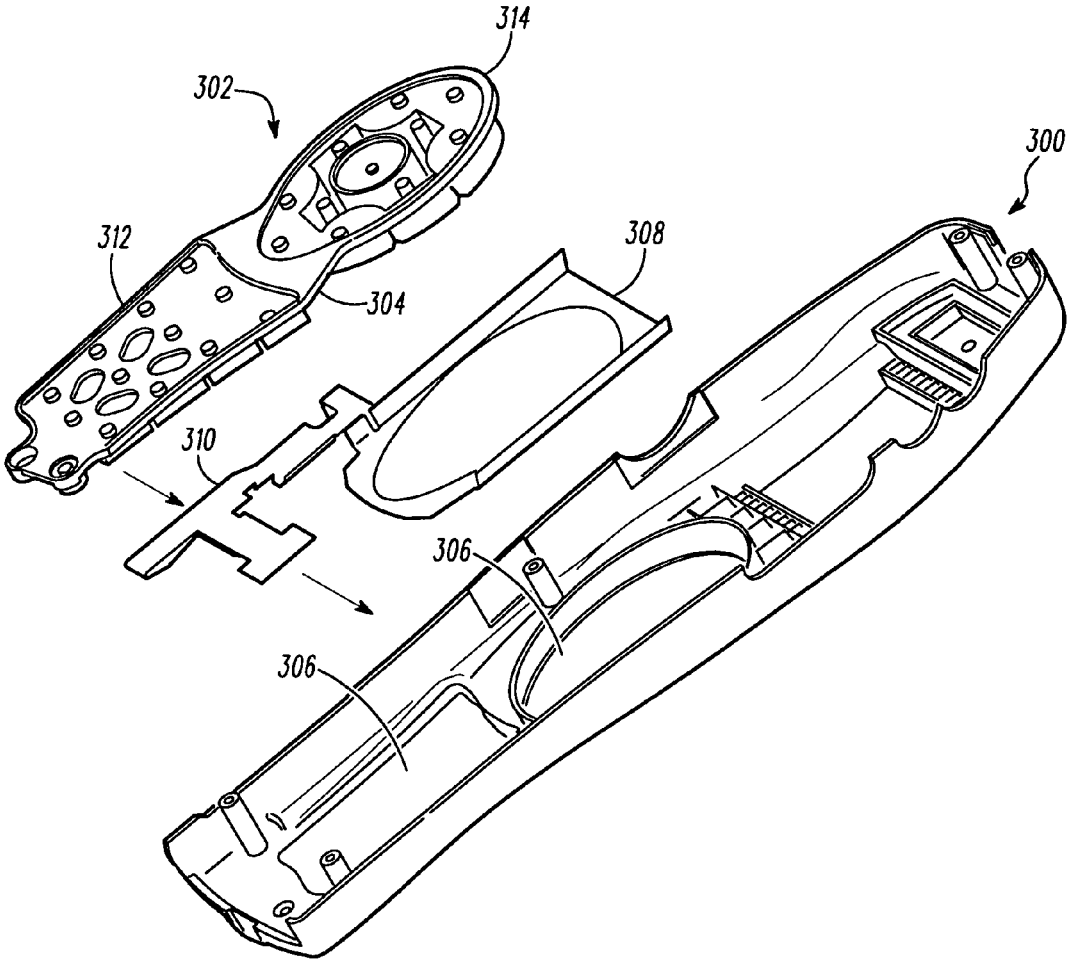
FIG. 3 illustrates a phone cover assembly including a keypad and an antenna subassembly, according to an embodiment of the present invention.

FIG. 3 illustrates a top-back exploded view of a cellular telephone cover 300 with a keypad assembly 302, according to an exemplary embodiment of the present invention. The cellular phone cover 300 is provided with openings 306. The exemplary cellular telephone cover 300 is constructed of molded plastic or other non-conductive materials in the exemplary embodiment. The top-back view illustrates how the keypad assembly 302, which is provided with two separate key pad sections 312 and 314, fits into the openings 306 of the exemplary cellular telephone cover 300 from an inside surface so that each of the keypad sections are visible and accessible from an outside surface (not shown) of the cover 300. The keypad assembly 302 has a flange 304 that is larger than the openings 306. The flange 304 prevents each of the keypad sections 312 and 314 from passing completely through the cover 300.

Also seen in FIG. 3 is a loop antenna assembly 308. The loop antenna assembly 308 comprises a conductor attached to a supporting material that gives the antenna a wide flattened appearance. In practice, the antenna can simply be one or more turns of a conducting pathway, such as a wire. The antenna conductor can be attached to the supporting material or encapsulated within the material. The supporting material ensures that the thin antenna element will retain its basic shape. In one embodiment, the material allows the antenna element to flex. The encapsulation protects the element from the environment and from other types of damage. The encapsulation also adds strength to the element.

Because the antenna assembly 308 is substantially flat in shape, it can be sandwiched between the keypad 302 and the front cover 300. Two immediate advantages are obtained by placing the antenna assembly 308 between the keypad 302 and front cover 300. First, the antenna is located just beneath the front cover. This position provides protection for the antenna, while allowing the antenna to radiate and receive with minimal attenuation, since only the non-conductive cover 300 needs to be penetrated by the radio waves.

Secondly, the antenna 308 resides in a location that does not add overall size to the device. The loop antenna assembly 308 is substantially flat and fits compactly between the keypad 302 and the cover 300. In another embodiment of the present invention, the antenna can be placed within, and become integral with, the flange 304 of the keypad assembly 302. In this embodiment, the keypad assembly itself provides physical support and protection to the antenna.

To secure the keypad assembly 302 and antenna assembly 308 to the cover 300, an adhesive can be applied to both sides of the antenna assembly 308. The antenna assembly is then sandwiched between the keypad assembly 302 and cover 300. Because, in this embodiment, the antenna is at least one linking feature between the keypad assembly 302 and the cover 300, embedding the antenna element in a protective material is advantageous. The protective material surrounding the antenna element provides strength to the bond between the keypad assembly 302 and cover 300 and to the antenna element and help prevent distortion when the phone is subject to twisting or pulling forces.

In other embodiments, the keypad assembly 302 is attached to the cover by means other than adhesive, such as slots, latches, hardware, or other similar means as should be obvious to those of ordinary skill in the art in view of the present discussion. Similarly, the antenna assembly 308 or antenna element 100 can be attached to the cover by means other than adhesive.

Figure 4:
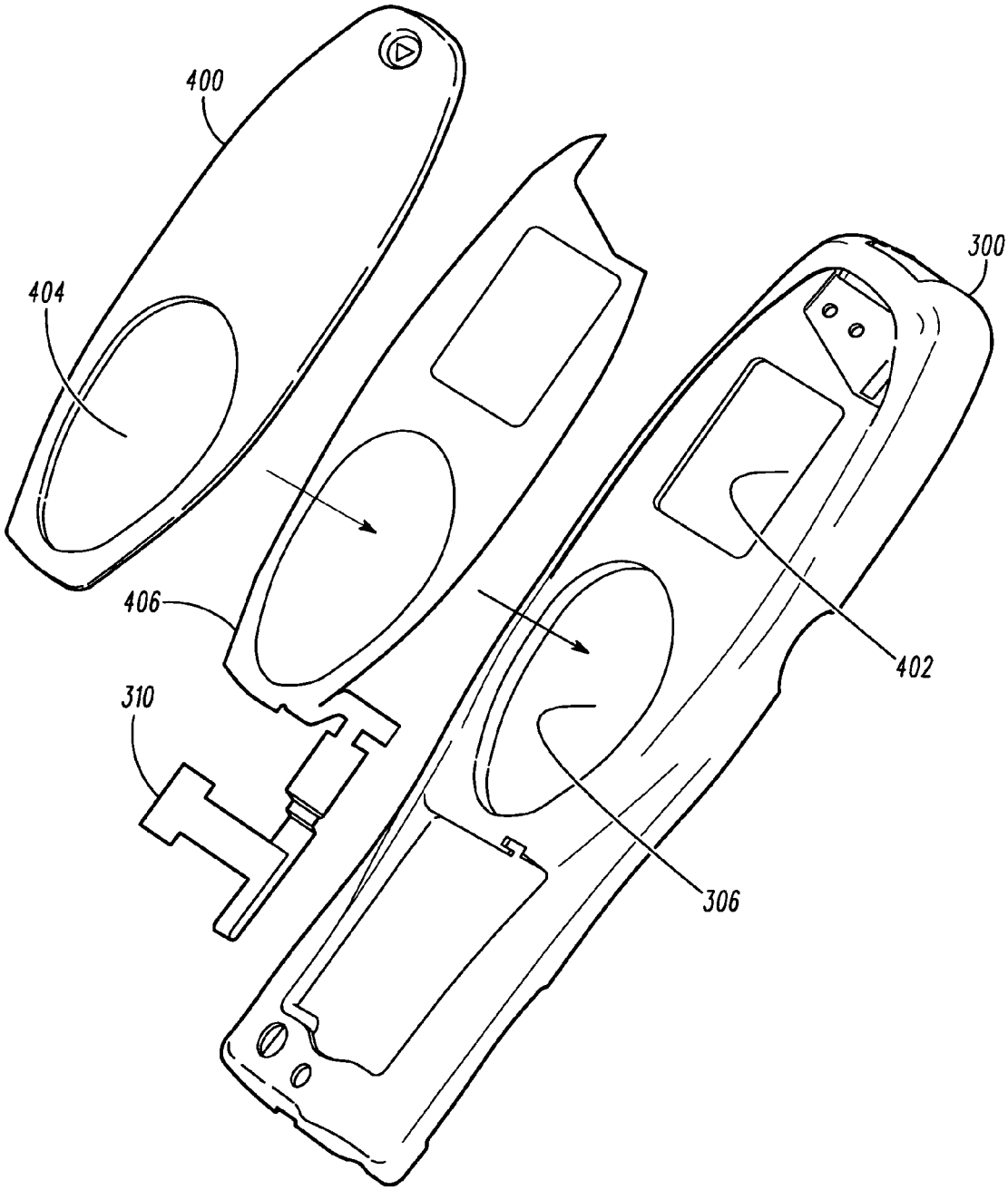
FIG. 4 illustrates a phone cover assembly including an antenna subassembly and a lens, according to an embodiment of the present invention.

FIG. 4 shows an alternative embodiment of the present invention. In the illustrative view of FIG. 4, the cellular phone cover 300 is shown from the front side. Additionally, an outer lens 400 can be seen. The outer lens 400 covers and protects a display screen (not shown) that is, when the phone is assembled, inserted into an opening 402 in the cover 300. The lens 400 can be clear or slightly opaque so that only characters on the screen can be seen and the actual display screen and the opening 402 cannot. In the particular embodiment shown, the outer lens 400 is longer than is necessary to cover the display opening 402. The lens 400 continues down around the opening 306 and is provided with a lens opening 404 to allow access to a keypad once the phone is assembled. The area between the front of the cover 300 and the outer lens 400 provides an ideal location for placing a NFC loop antenna assembly 406.

The view shown in FIG. 4 is an exploded view of an assembly that includes the NFC loop antenna 406, the phone cover 300, and the outer lens 400. In this embodiment, three pieces can be put together so that the antenna 406 is secured, by adhesive or otherwise, between the lens 400 and the phone cover 300.

Figure 5:
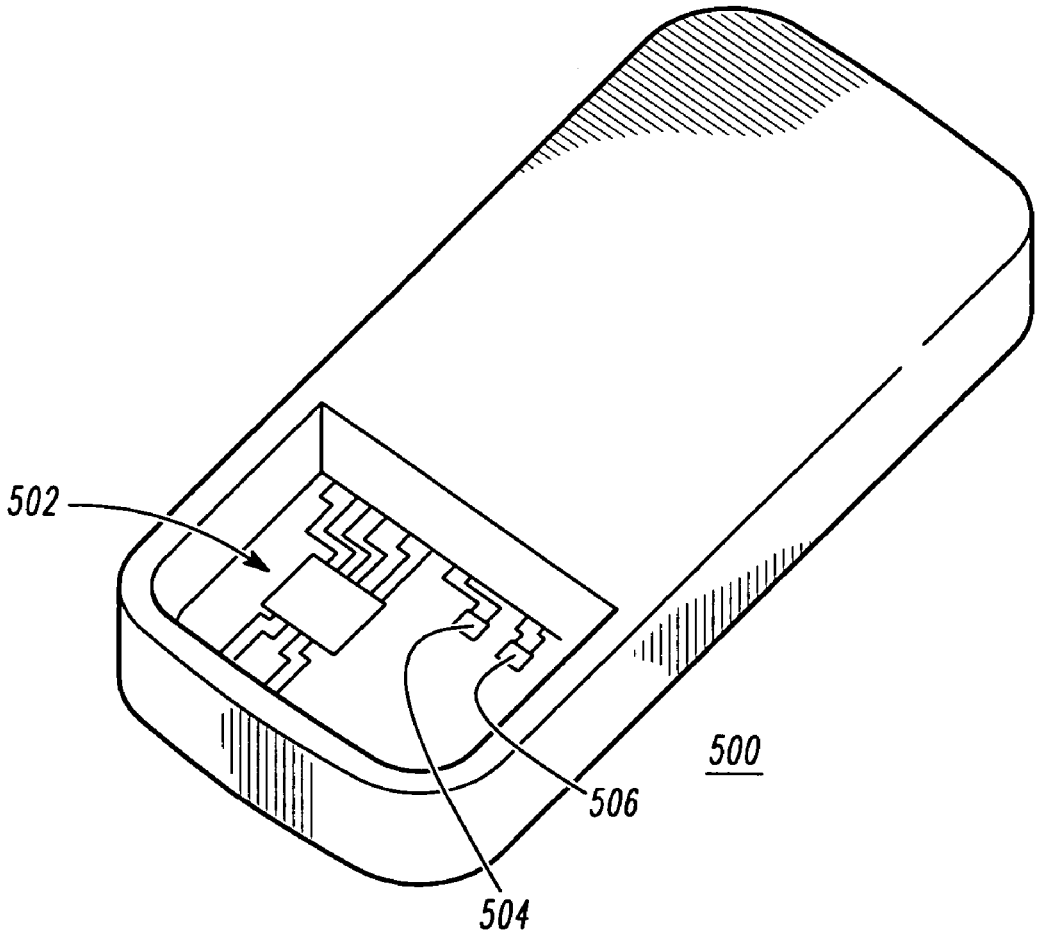
FIG. 5 illustrates a top-back view of the cellular telephone device, according to an embodiment of the present invention.

Referring now to FIG. 5, a top-back view of a cellular telephone 500 is shown. The cellular telephone 500 is provided with an RF circuit module and controller circuits, generally shown as part of internal circuits 502. The RF circuit module includes a circuit board with an RF transmission circuit and an RF receiving circuit. The RF circuit module of the exemplary embodiment has two RF contacts 504 and 506 that provide an RF connection interface used to couple RF signals between the RF circuit module and the loop antenna 100 (see FIG. 1).

In both the embodiment of FIG. 3 and the embodiment of FIG. 4, the loop antenna can have any number of turns and can be of any dimension and shape that will fit within the depicted and described areas and allow for proper communication. Proper communication may depend on the antenna having a certain inductance, Q factor, resonant frequency, and other similar factors. In each of the embodiments shown, the antenna assembly 308 and 406 has an extended portion 310 that is used to supply RF signals to, and receive RF signals from, the antenna. The extended portion 310 ensures that the leads to the antenna remain separated from each other by a fixed distance. The extended portion 310 can be used to couple the antenna to the RF contacts 504 and 506 of the RF circuit module 502, so that the loop antenna may be used for reception of RF signals that are received and coupled from the loop antenna to the RF circuit module, or for transmission of RF signals that are coupled from the RF circuit module to the loop antenna, or both.

In another embodiment of the present invention, the NFC loop antenna element can be embedded within the cellular phone cover 300. The cover 300 provides physical protection for the antenna element while causing minimal attenuation due to the non-conductive material used to form the cover. In this embodiment, embedding means that the antenna element 100 is as least partially contained within the cover material.

In the embodiments described herein, an NFC loop antenna has been shown to be advantageously located just under, within, or on the outside surface of a cellular phone cover. By placing the antenna between the keypad and cover, within the cover itself, or between the lens and the cover, the antenna is placed in a functionally advantageous location without requiring additional space in the device or negatively affecting any other feature of the device.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

For example, although an NFC antenna has been described herein, other frequencies may be used and are within the spirit and scope of the present invention.

What is claimed is:

1. An apparatus for wireless communication, the apparatus comprising:

a cover for a mobile communication device, the cover having an inside surface and an outside surface;

a near field communication antenna mechanically coupled to the outside surface of the cover, wherein the near field communication antenna comprises a loop antenna having multiple turns; and a lens mechanically coupled to the cover, whereby the near field communication antenna is located between the cover and at least a portion of the lens.

2. The apparatus according to claim 1, wherein all the turns of the loop antenna at least partially surround a display opening in the cover.

3. The apparatus according to claim 1, wherein the mechanical coupling of the near field communication antenna to the outside surface of the cover is performed via an adhesive material.

4. The apparatus according to claim 1, wherein the near field communication antenna is encapsulated in an element-supporting material.

5. The apparatus according to claim 1, further comprising:

a circuit board including at least one of an RF transmission circuit and an RF receiving circuit, the circuit board being electrically coupled to the near field communication antenna.

6. An apparatus for wireless communication, the apparatus comprising:

a cover for a mobile communication device, the cover having an inside surface and an outside surface;

a short-range communication antenna mechanically coupled to the outside surface of the cover, wherein the short-range communication antenna is a loop antenna having multiple turns; and a lens mechanically coupled to the cover, whereby the short-range communication antenna is located between the cover and at least a portion of the lens.

7. The apparatus of claim 6, wherein the short-range communication antenna transmits an electromagnetic signal a distance of no more than four feet at a frequency of about 13.5 MHz.

* * * * *